US012778213B2

(12) United States Patent
Jiang

(10) Patent No.: US 12,778,213 B2
(45) Date of Patent: Nov. 3, 2026

(54) BRASSIERE

(71) Applicant: Shenzhen Lute Jiacheng Supply Chain Management Co., Ltd., Shenzhen (CN)

(72) Inventor: Na Jiang, Shenzhen (CN)

(73) Assignee: Shenzhen Lute Jiacheng Supply Chain Management Co., Ltd., Shenzhen (CN)

( * ) Notice: Subject to any disclaimer, the term of this patent is extended or adjusted under 35 U.S.C. 154(b) by 0 days.

(21) Appl. No.: 19/342,590

(22) Filed: Sep. 28, 2025

(65) Prior Publication Data

US 2026/0020624 A1 Jan. 22, 2026

(30) Foreign Application Priority Data

Aug. 8, 2025 (CN) ..... 202521692240.2

(51) Int. Cl.
*A41C 3/00* (2006.01)
*A41C 3/12* (2006.01)

(52) U.S. Cl.
CPC ..... *A41C 3/0007* (2013.01); *A41C 3/128* (2013.01)

(58) Field of Classification Search
CPC ..... A41C 3/0007; A41C 3/122; A41C 3/128
USPC ..... 450/41
See application file for complete search history.

(56) References Cited

U.S. PATENT DOCUMENTS 6,053,800 A * 4/2000 Lattanzi ..... A41C 3/128 450/47
6,439,959 B1 * 8/2002 Magrone ..... A41C 3/0014 450/41
6,572,437 B1 * 6/2003 Waitz ..... A41C 3/00 450/1
6,846,219 B2 * 1/2005 Moyer ..... A41C 3/00 450/86
6,966,815 B2 * 11/2005 Weinerth ..... A41C 3/10 450/39
7,604,526 B2 * 10/2009 Liu ..... A41C 3/122 450/39

(Continued)

FOREIGN PATENT DOCUMENTS

CN 221887717 U * 10/2024
CN 223068011 U * 7/2025
JP 3246505 U 4/2024

OTHER PUBLICATIONS

Gao, Cynthia. "Lace vs Mesh: The Difference Between Mesh Fabric and Lace Fabric." Sep. 17, 2025. https://www.longancraft.com/blogs/fabric-knowledge/lace-vs-mesh-the-difference-between-mesh-fabric-and-lace-fabric (Year: 2025).*

*Primary Examiner* — Grace Huang

(57) ABSTRACT

The present application discloses a brassiere comprising: a brassiere body comprising a breast-covering portion configured to cover a wearer's breasts when worn and a torso-covering portion configured to cover the wearer's torso surrounding the breasts when worn, the brassiere body having a first edge adjacent the wearer's underarm when worn and a second edge adjacent the wearer's neckline when worn; a support structure connected to the brassiere body, wherein the support structure has greater rigidity than the brassiere body and is configured to extend around the wearer's breasts when worn, the support structure extending to and terminating at the first edge; and a cushion panel joined to the brassiere body at the first edge.

18 Claims, 5 Drawing Sheets

(56) References Cited

U.S. PATENT DOCUMENTS

| | | | | |
|---|---|---|---|---|
| 7,922,560 | B2 * | 4/2011 | Avalos-Dessner | A41C 3/10 450/39 |
| 8,464,401 | B2 * | 6/2013 | Littell | A41C 3/12 24/3.1 |
| 8,747,184 | B2 * | 6/2014 | Liu | A41C 3/0007 450/47 |
| 9,655,387 | B2 * | 5/2017 | Yip | A41C 3/0014 |
| 9,717,284 | B2 * | 8/2017 | Misseldine | A41C 3/0007 |
| 9,867,402 | B2 * | 1/2018 | West | A41C 3/142 |
| 10,368,591 | B2 * | 8/2019 | Funk-Danielson | A41C 3/0007 |
| 11,172,711 | B2 * | 11/2021 | Randall | A41C 3/02 |
| 11,246,354 | B2 * | 2/2022 | Blecha | A41C 3/12 |
| 11,324,262 | B2 * | 5/2022 | Lien | A41C 3/0007 |
| 12,342,876 | B1 * | 7/2025 | Anderson | A41C 3/128 |
| 2009/0325463 | A1 * | 12/2009 | Vidal | A41C 3/126 450/39 |
| 2014/0302747 | A1 * | 10/2014 | Siddall-Cohen | A41C 3/122 450/41 |
| 2024/0090596 | A1 * | 3/2024 | Roberts | A41C 3/142 |

* cited by examiner

BRASSIERE

CROSS-REFERENCE TO RELATED APPLICATIONS

The present application claims priority to Chinese Patent Application No. 202521692240.2, filed on Aug. 8, 2025, the entire contents of which are incorporated herein by reference.

TECHNICAL FIELD

The present application relates to the technical field of maternal and baby products, particularly to a brassiere.

BACKGROUND

Currently, as consumer demand for comfortable and functional undergarments continues to grow, the design and structure of brassieres have become a focal point of research. As intimate apparel worn in direct contact with the body, the design of a brassiere's support structure directly impacts wearer comfort and breast support efficacy.

In conventional technologies, brassiere support structures typically employ materials such as underwires, memory plastic strips, or elastic polymer strips. While these support structures significantly enhance the brassiere's supportive force and shaping effect, several unresolved technical issues persist.

On one hand, certain brassiere designs extend the support structure to the underarm region to provide improved breast support and shaping. However, because the terminal ends of the support structure directly press against the underarm skin or soft tissue, wearers may experience noticeable discomfort during movement, potentially leading to localized pressure, friction, or even skin irritation. These issues become particularly pronounced during prolonged wear or physical activity, substantially compromising user experience.

On the other hand, some brassieres adopt shorter support structures that do not extend to the underarm area to mitigate discomfort. While this approach partially alleviates underarm irritation, the insufficient coverage of the support structure results in inadequate breast support and shaping performance. This deficiency is especially evident for wearers with larger bust sizes, often causing brassiere slippage, sagging, or suboptimal shaping effects.

Consequently, there exists an urgent need in the art for a brassiere support structure design that effectively balances comfort and support performance. An optimal solution should simultaneously prevent discomfort caused by support structure ends pressing against the underarm while ensuring sufficient extension of the support structure to the underarm region for comprehensive support, thereby enhancing overall wearability and functionality of the brassiere.

SUMMARY

In view of the deficiencies in the prior art, embodiments of the present application provide a brassiere capable of resolving the problems of either inadequate support or poor comfort in conventional brassieres.

To address the above technical problems, one embodiment provided by this application is: a brassiere comprising: a brassiere body comprising a breast-covering portion configured to cover a wearer's breasts when worn and a torso-covering portion configured to cover the wearer's torso surrounding the breasts when worn, the brassiere body having a first edge adjacent the wearer's underarm when worn and a second edge adjacent the wearer's neckline when worn; a support structure connected to the brassiere body, wherein the support structure has greater rigidity than the brassiere body and is configured to extend around the wearer's breasts when worn to provide breast support, the support structure extending to and terminating at the first edge; and a cushion panel joined to the brassiere body at the first edge.

In one embodiment, the cushion panel has a higher elastic modulus than the breast-covering portion.

In one embodiment, the cushion panel and the brassiere body partially overlap at a joining position therebetween, and the cushion panel is closer to the wearer's skin than the brassiere body at the joining position.

In one embodiment, a first end of the support structure terminates at the first edge, and the cushion panel has a maximum width at a first location corresponding to the first end.

In one embodiment, the cushion panel tapers gradually from the first location toward both ends along a length direction of the cushion panel.

In one embodiment, an extension area of the cushion panel covers at least 80% of the first edge.

In one embodiment, the extension area of the cushion panel covers the entire first edge.

In one embodiment, the support structure is configured to extend between the wearer's breasts when worn and terminates at the second edge.

In one embodiment, the support structure is disposed on an outer surface of the brassiere body and protrudes outward relative to the outer surface.

In one embodiment, the brassiere further comprising a support structure covering layer that at least covers the support structure and is bonded thereto, the covering layer being disposed on an outer side of the support structure.

In one embodiment, the covering layer is folded around at least part of an edge of the support structure to cover an inner side of the support structure.

In one embodiment, the support structure is adhesively bonded to the brassiere body.

In one embodiment, the covering layer is adhesively bonded to the support structure.

In one embodiment, the support structure comprises: a first U-shaped strip and a second U-shaped strip disposed in a same layer; a W-shaped support strip; and a covering sheet; wherein the first U-shaped strip, the W-shaped support strip, and the covering sheet are sequentially stacked from inside to outside, and the covering sheet is softer than the first U-shaped strip, the second U-shaped strip, and the W-shaped support strip.

In one embodiment, the W-shaped support strip comprises: a first W-shaped strip; first and second plastic bones disposed in a same layer; and a second W-shaped strip; wherein the first W-shaped strip, the first plastic bone, and the second W-shaped strip are sequentially stacked from inside to outside.

To address the above technical problems, another embodiment provided by this application is: a brassiere comprising: a brassiere body comprising a breast-covering portion configured to cover a wearer's breasts when worn and a torso-covering portion configured to cover the wearer's torso surrounding the breasts when worn, the brassiere body having a first edge adjacent the wearer's underarm when worn and a second edge adjacent the wearer's neckline when worn; a support structure connected to the brassiere body, wherein the support structure has greater rigidity than the brassiere body and is configured to extend around the wearer's breasts when worn to provide breast support, the support structure extending to and terminating at the first edge, being disposed on an outer surface of the brassiere body and protruding outward relative to the outer surface, and being adhesively bonded to the brassiere body; and a cushion panel joined to the brassiere body at the first edge.

To address the above technical problems, another embodiment provided by this application is: a brassiere comprising: a brassiere body comprising a breast-covering portion configured to cover a wearer's breasts when worn and a torso-covering portion configured to cover the wearer's torso surrounding the breasts when worn, the brassiere body having a first edge adjacent the wearer's underarm when worn and a second edge adjacent the wearer's neckline when worn; a support structure connected to the brassiere body, wherein the support structure has greater rigidity than the brassiere body and is configured to extend around the wearer's breasts when worn to provide breast support, the support structure extending to and terminating at the first edge and being further configured to extend between the wearer's breasts when worn and terminate at the second edge; and a cushion panel joined to the brassiere body at the first edge, the cushion panel having a higher elastic modulus than the breast-covering portion.

The embodiments of the present application provide a brassiere comprising: a brassiere body including a breast-covering portion configured to cover a wearer's breasts when worn and a torso-covering portion configured to cover the wearer's torso surrounding the breasts when worn, the brassiere body having a first edge adjacent the wearer's underarm when worn and a second edge adjacent the wearer's neckline when worn; a support structure connected to the brassiere body, the support structure having greater rigidity than the brassiere body and being configured to extend around the wearer's breasts when worn to provide breast support, the support structure extending to and terminating at the first edge; and a cushion panel joined to the brassiere body at the first edge. The widened cushion panel at the underarm edge prevents discomfort caused by the terminal end of the support structure pressing against the body, while the extension of the support structure to the first edge of the brassiere body ensures complete support performance. Additionally, the cushion panel effectively gathers side breast tissue for improved shaping.

BRIEF DESCRIPTION OF THE DRAWINGS

To more clearly illustrate the technical solutions of the embodiments of the present application or the prior art, a brief introduction of the drawings used in the description of the embodiments or the prior art is provided below. It is apparent that the drawings described below only illustrate some embodiments of the present application. For those skilled in the art, other drawings may be obtained based on the structures shown in these drawings without any creative effort.

The achievement of the objectives, functional features, and advantages of the present application will be described in detail in combination with the embodiments and with reference to the accompanying drawings.

DETAILED DESCRIPTION OF THE EMBODIMENTS

In the present application, the terms "arranged," "provided with," and "connected" should be understood broadly. For example, a connection may be fixed, detachable, or integrally constructed; it may be mechanical or electrical; it may be direct or indirectly connected through an intermediary, or it may refer to internal communication between two devices, components, or constituent parts. Those of ordinary skill in the art can understand the specific meanings of these terms in the context of the present application based on specific circumstances.

The terms "center," "longitudinal," "transverse," "length," "width," "thickness," "upper," "lower," "front," "rear," "left," "right," "vertical," "horizontal," "top," "bottom," "inner," "outer," "radial," and "circumferential" are used to describe orientations or positional relationships based on the orientations or positional relationships shown in the accompanying drawings. These terms are used solely for the purpose of facilitating the description of the present application and simplifying the description, and do not indicate or imply that the referenced devices or components must have a specific orientation or be constructed and operated in a specific orientation. Therefore, these terms should not be construed as limiting the present application.

Furthermore, the terms "first" and "second" are used for descriptive purposes only and should not be construed as indicating or implying relative importance or implicitly specifying the quantity of the indicated technical features. Thus, features defined by "first" or "second" may explicitly or implicitly comprise at least one such feature. In the description of the present application, the term "plurality" means at least two, such as two, three, etc., unless explicitly stated otherwise.

Additionally, some of the above terms may be used to indicate meanings other than orientation or positional relationships. For example, the term "upper" may, in some cases, also be used to indicate a certain dependency or connection relationship. Those of ordinary skill in the art can understand the specific meanings of these terms in the context of the present application based on specific circumstances.

Figure 1:
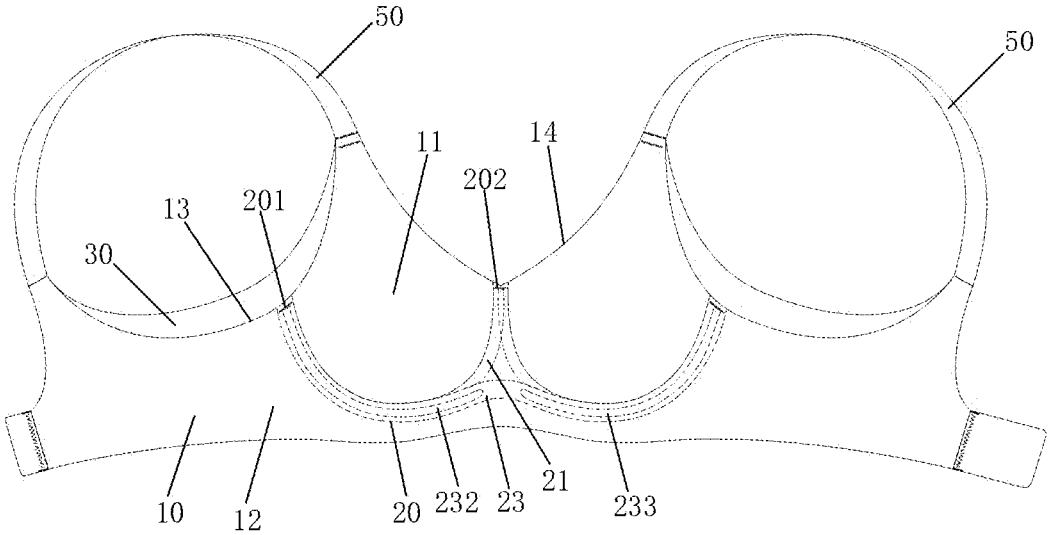
FIG. 1 is a schematic front view structural diagram of a brassiere according to an embodiment of the present application.
Figure 2:
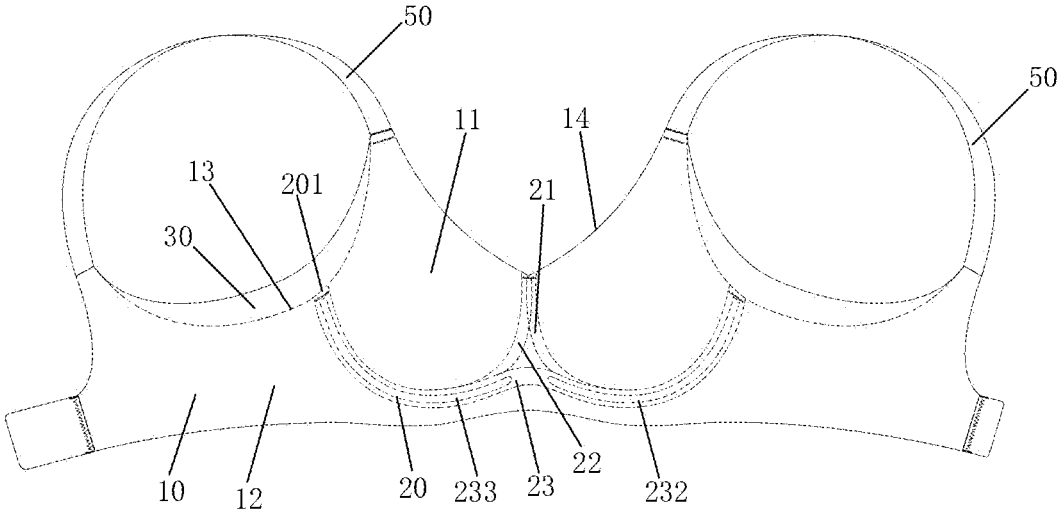
FIG. 2 is a schematic rear view structural diagram of the brassiere according to an embodiment of the present application.
Figure 3:
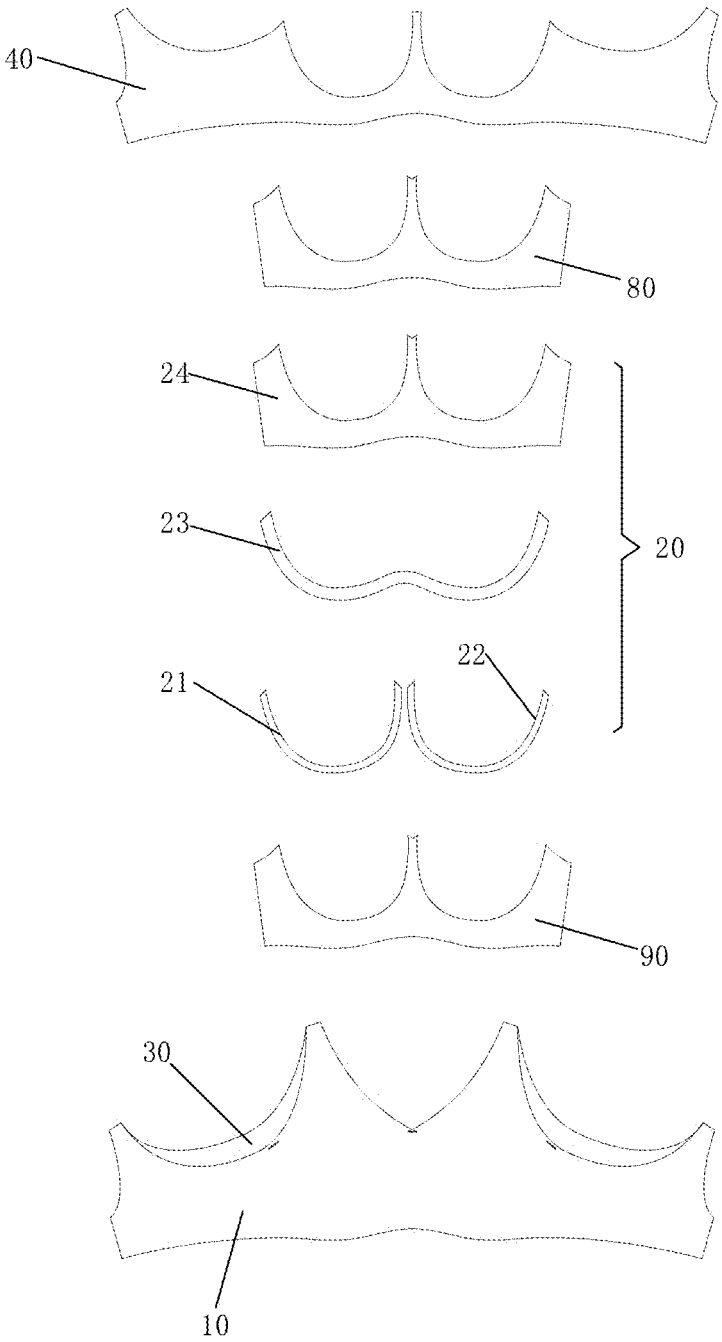
FIG. 3 is an exploded view structural diagram of the brassiere according to an embodiment of the present application.
Figure 4:
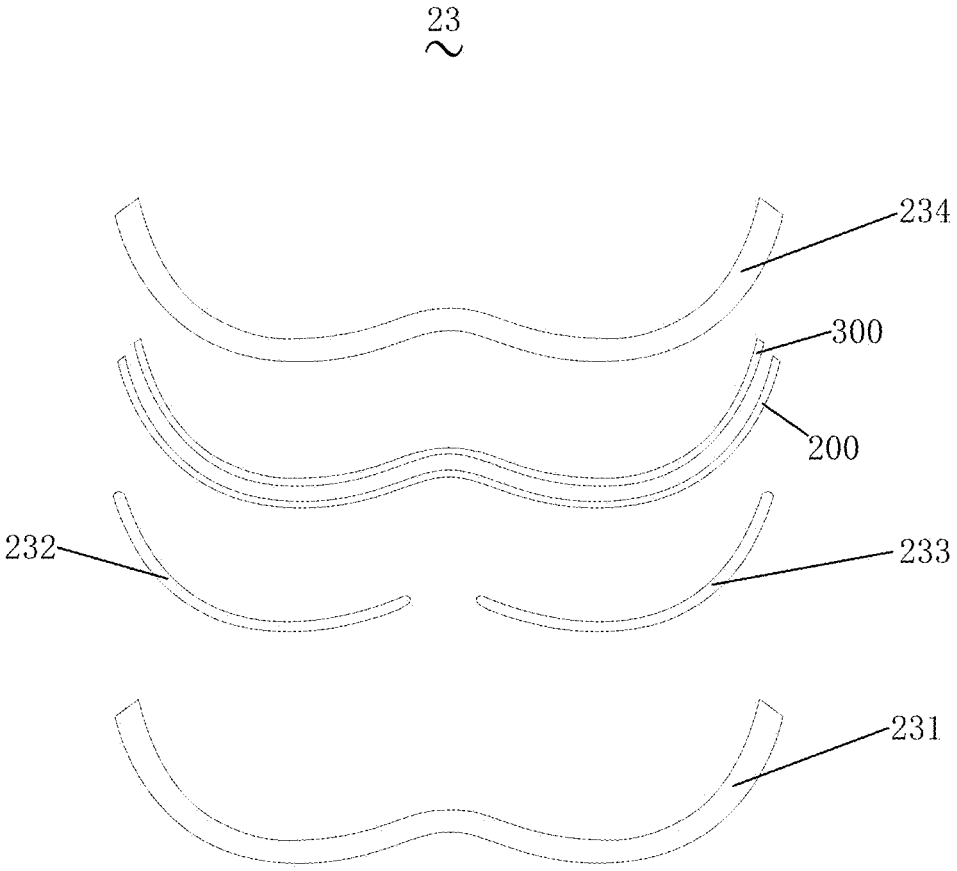
FIG. 4 is an exploded view structural diagram of the W-shaped support strip in an embodiment of the present application.
Figure 5:
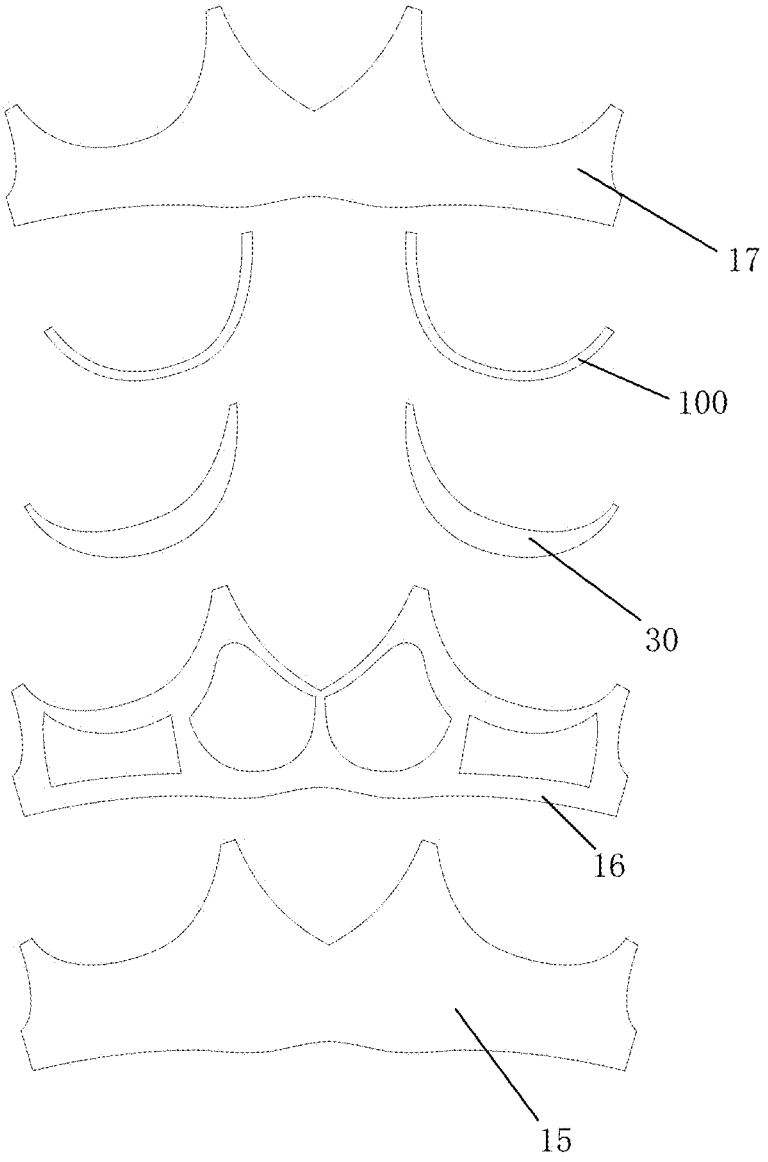
FIG. 5 is a structural diagram showing the brassiere body and cushion panel according to an embodiment of the present application.
Figure 6:
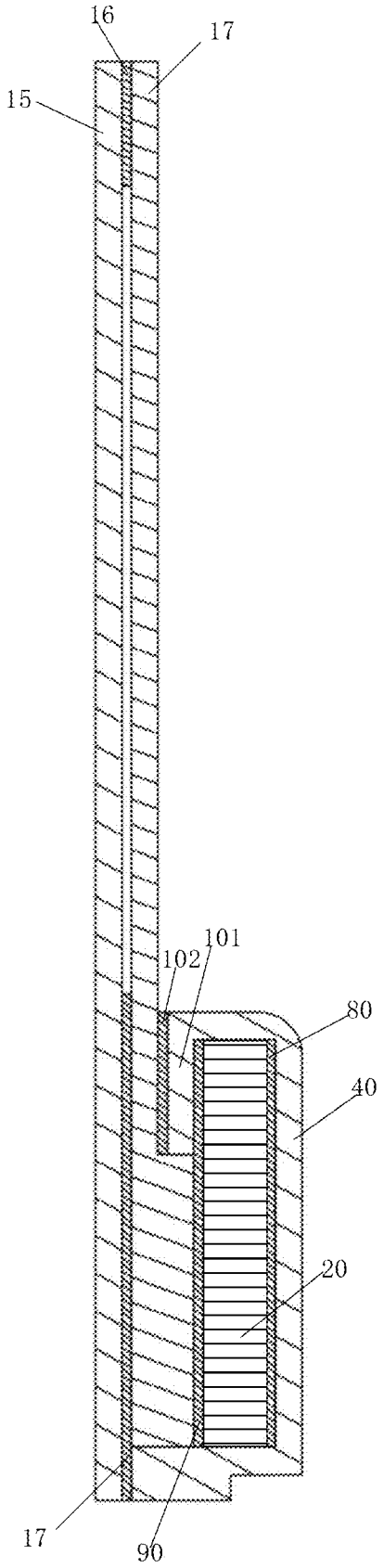
FIG. 6 is a cross-sectional structural diagram of the brassiere according to an embodiment of the present application.

Please refer to FIGS. 1 to 6. FIG. 1 is a schematic front view structural diagram of a brassiere according to an embodiment of the present application; FIG. 2 is a schematic rear view structural diagram of the brassiere according to an embodiment of the present application; FIG. 3 is an exploded view structural diagram of the brassiere according to an embodiment of the present application; FIG. 4 is an exploded view structural diagram of the W-shaped support strip in an embodiment of the present application; FIG. 5 is a structural diagram showing the brassiere body and cushion panel according to an embodiment of the present application; FIG. 6 is a cross-sectional structural diagram of the brassiere according to an embodiment of the present application.

As shown in FIGS. 1, 2, 3, 5 and 6, the brassiere according to embodiments of the present application may comprise a brassiere body 10, a support structure 20, and a cushion panel 30.

As shown in FIGS. 1, 2, 3, 5 and 6, the brassiere body 10 comprises a breast-covering portion 11 and a torso-covering portion 12. The breast-covering portion 11 is configured to cover a wearer's breasts when worn, while the torso-covering portion 12 is configured to cover the wearer's torso surrounding the breasts when worn. The brassiere body 10 has a first edge 13 adjacent to the wearer's underarm when worn and a second edge 14 adjacent to the wearer's neckline when worn.

In the present embodiment, the breast-covering portion 11 does not comprise molded cups, being instead formed by one layer, two layers, or multiple layers of fabric. In some alternative implementations, the breast-covering portion 11 may incorporate molded cups. Such molded cups are primarily manufactured through mold-based heat pressing processes and serve to provide cup shaping and support. Common materials for the molded cups comprise foam, sponge, or elastic fibers.

As shown in FIGS. 1, 2, 3, 5 and 6, the support structure 20 is connected to the brassiere body 10. The support structure 20 has greater rigidity than the brassiere body 10 and is configured to extend around the wearer's breasts when worn to provide breast support.

As shown in FIGS. 1 and 2, the support structure 20 extending to and terminating at the first edge 13.

The brassiere body 10 may be constructed of single-layer, double-layer, or multi-layer nylon-spandex or polyester-spandex fabric, with specific details provided in the following description. In one implementation, the brassiere body 10 comprises a laminated structure including an inner layer 15, an adhesive layer 16, and an outer layer 17, where the inner layer 15 and outer layer 17 are bonded together through the adhesive layer 16.

The inner layer 15 may be made of nylon-spandex or polyester-spandex fabric, while the outer layer 17 may similarly comprise nylon-spandex or polyester-spandex fabric.

As shown in FIGS. 1 and 2, the cushion panel 30 is joined to the brassiere body 10 at the first edge 13. In one implementation, the cushion panel 30 is adhesively bonded to the brassiere body 10. Specifically, the cushion panel 30 and brassiere body 10 are bonded together through an elastic adhesive film 100.

In the present embodiment, by extending the terminal end 201 of the support structure 20 to the first edge 13 adjacent to the wearer's underarm, complete breast support can be achieved for the wearer. Furthermore, through the joining of the cushion panel 30 with the brassiere body 10 at the first edge 13, the widened cushion panel 30 at the underarm edge prevents discomfort caused by the terminal end 201 of the support structure pressing against the body.

The extension of the support structure 20 to the first edge 13 of the brassiere body 10 ensures comprehensive support performance, while simultaneously enabling the cushion panel 30 to effectively gather side breast tissue for improved shaping.

In one embodiment, the cushion panel 30 and the brassiere body 10 partially overlap at a joining position therebetween, and the cushion panel 30 is closer to the wearer's skin than the brassiere body 10 at the joining position. For example, the cushion panel 30 and the brassiere body 10 are partially overlapped and adhesively bonded at the first edge 13, with the cushion panel 30 located on the inner layer closer to the wearer's skin at the overlapping region. This enhances the cushioning effect of the cushion panel 30 and reduces discomfort caused by the support structure 20. It should be understood that, in other embodiments, the cushion panel may be farther from the wearer's skin than the brassiere body at the joining position, which is not limited in the embodiments of the present application.

In one embodiment, the first end 201 of the support structure 20 extends to and terminates at the first edge 13, and the cushion panel 30 has a maximum width at a first location corresponding to the first end 201. This configuration provides a larger cushioning space at the first location corresponding to the end 201 of the support structure 20, while improving wearing comfort at other portions of the cushion panel 30 and better adapting to the curve of the wearer's underarm.

In one embodiment, the cushion panel 30 tapers gradually from the first location toward both ends along its length direction.

In one embodiment, an extension area of the cushion panel 30 covers at least 80% of the first edge. This configuration provides improved cushioning effect and wearing comfort.

In one embodiment, the extension area of the cushion panel 30 covers the entire first edge.

The elastic adhesive film 100 has a controlled thickness ranging from 0.1 mm to 0.3 mm, which ensures a secure bond between the cushion panel 30 and the brassiere body 10 while preventing any compromise to the overall softness and wearing comfort of the brassiere due to excessive thickness.

The cushion panel 30 not only provides effective cushioning performance but also significantly enhances moisture-wicking properties during wear, thereby preventing discomfort caused by localized heat accumulation.

Additionally, the peripheral edges of the cushion panel 30 feature rounded corner processing with a radius setting of 5 mm to 8 mm. This design further reduces skin friction during wear and improves overall wearing comfort.

At the joining area between the cushion panel 30 and the brassiere body 10, a plurality of micro-ventilation holes may be incorporated. These ventilation holes, measuring 0.5 mm to 1 mm in diameter with 3 mm to 5 mm spacing between adjacent holes, significantly enhance air permeability in the joined region. This ventilation system allows the brassiere to maintain excellent breathability while providing optimal support and cushioning functions.

In one implementation, the cushion panel 30 has a higher elastic modulus than the breast-covering portion 11. For example, the cushion panel 30 is made of nylon-spandex or polyester-spandex fabric, with a higher spandex yarn content than that in the breast-covering portion 11, thereby giving the cushion panel 30 a higher elastic modulus than the breast-covering portion 11. As another example, the cushion panel 30 is formed by laminating and bonding two fabric layers, comprising an inner layer, an outer layer, and an adhesive layer disposed between the inner and outer layers of the cushion panel 30, where the adhesive layer in the cushion panel 30 has a greater thickness than the adhesive layer 16, thereby giving the cushion panel 30 a higher elastic modulus than the breast-covering portion 11. In some implementations, the adhesive in the adhesive layer of the cushion panel 30 is discretely distributed between the inner and outer layers of the cushion panel 30, thereby improving the breathability of the cushion panel 30, particularly in the underarm area corresponding to the cushion panel 30 where the wearer is prone to sweating. By configuring the cushion panel 30 to have a relatively higher elastic modulus, the effect of the cushion panel 30 in gathering side breast tissue can be enhanced, improving breast shaping performance.

As shown in FIGS. 1 and 2, in one implementation, the support structure 20 is configured to extend between the wearer's breasts when worn and terminate at the second edge 14. The terminal end 202 of the support structure 20 extends to and terminates at the second edge 14 along the position between the wearer's two breasts when worn. This configuration allows the support structure 20 to completely separate the wearer's left and right breasts in the intermammary region, thereby enhancing breast shaping performance.

As shown in FIG. 6, in one implementation, the support structure 20 is disposed on the outer surface of the brassiere body 10 and protrudes outward relative to the outer surface of the brassiere body 10. This externally visible configuration of the support structure 20 further accentuates the visual separation effect between the left and right breasts, thereby enhancing the breast shaping performance.

As shown in FIGS. 3 and 6, in one implementation, the brassiere further comprises a support structure covering layer 40 that at least covers the area where the support structure 20 is located and is bonded to the support structure 20, with the support structure covering layer 40 being disposed on the outer side of the support structure 20. The material of the support structure covering layer 40 is softer than that of the support structure 20. On one hand, the support structure covering layer 40 can conceal the support structure 20; on the other hand, it can provide cushioning to enhance comfort by preventing the harder support structure 20 from directly contacting the wearer's body.

As shown in FIG. 6, in one implementation, at least part of the support structure covering layer 40 is folded around the edge of the support structure 20 to cover the inner side of the support structure 20. A portion 101 of the support structure covering layer 40 is folded around the edge of the support structure 20 to cover the inner side of the support structure 20, and this portion 101 is adhesively bonded to the inner side of the support structure 20 through an adhesive layer 90. The portion 101 is further adhesively bonded to the brassiere body 10 through an adhesive layer 102. In this way, the support structure 20 can protrude more prominently from the brassiere body 10, further accentuating the visual separation between the left and right breasts and improving the breast shaping effect.

As shown in FIGS. 3 and 6, in one implementation, the support structure 20 is adhesively bonded to the brassiere body 10, with the support structure 20 and brassiere body 10 being bonded together through an adhesive layer 90. In the embodiments of this application, the materials for the adhesive layer, elastic adhesive strips, and adhesives may comprise hot-melt pressure-sensitive adhesives, water-based environmentally friendly adhesives, reactive polyurethane hot-melt adhesives, acrylic adhesives, or polyurethane adhesives, all of which exhibit excellent bonding performance and environmental characteristics capable of meeting the requirements of different application scenarios. The hot-melt pressure-sensitive adhesives feature rapid curing and strong initial tack, making them suitable for applications requiring quick bonding and high initial adhesion strength, while water-based environmentally friendly adhesives are renowned for being eco-friendly, non-toxic, and odorless, better aligning with modern consumers' pursuit of healthy living. The reactive polyurethane hot-melt adhesives combine the excellent elasticity of polyurethane with the rapid curing properties of hot-melt adhesives, providing effective bonding while maintaining garment softness and comfort, whereas acrylic and polyurethane adhesives each have distinctive characteristics: acrylic adhesives demonstrate good weather resistance and water resistance, making them suitable for garment bonding in outdoor or humid environments, while polyurethane adhesives, with their high strength and wear resistance, are more appropriate for garment areas subject to significant tension or abrasion. By selecting the appropriate adhesive type, garment quality and durability can be further enhanced to satisfy diverse consumer needs.

As shown in FIGS. 3 and 6, in one implementation, the support structure covering layer 40 is adhesively bonded to the support structure 20, with the support structure covering layer 40 and support structure 20 being bonded together through an adhesive layer 80.

As shown in FIG. 3, in one implementation, the support structure 20 comprises a first U-shaped strip 21, a second U-shaped strip 22, a W-shaped support strip 23, and a covering sheet 24, where the first U-shaped strip 21 and the second U-shaped strip 22 are disposed in the same layer, while the first U-shaped strip 21, the W-shaped support strip 23, and the covering sheet 24 are sequentially laminated from the inner to outer layers, with the covering sheet 24 being softer than the first U-shaped strip 21, the second U-shaped strip 22, and the W-shaped support strip 23. The covering sheet 24 is a three-layer composite fabric comprising sequentially laminated polyester filament layer, low-elastic yarn layer, and polyester filament layer, which is also referred to as sandwich fabric, exhibiting high elastic modulus, support performance, and softness, with the low-elastic yarn maintaining an upright orientation. In addition to covering the first U-shaped strip 21, the second U-shaped strip 22, and the W-shaped support strip 23, the covering sheet 24 further extends to cover the entire front portion of the torso-covering section 12, thereby enhancing both the close-fitting and shaping effects of the torso-covering section 12.

The W-shaped support strip 23 has its middle region curved upward to form an arched structure that matches the curvature under the human breasts, providing stable supporting function. The first U-shaped strip 21 and second U-shaped strip 22 are arranged with their openings facing each other, with both ends fixedly connected to the side edges of the W-shaped support strip 23, together forming the basic framework of the support structure 20 to further enhance support stability. This multi-layer composite support structure design coordinates components of different materials and shapes to work together—while utilizing the first U-shaped strip 21, second U-shaped strip 22 and W-shaped support strip 23 to provide sufficient supporting force and prevent breast sagging, it also employs the soft covering sheet 24 to improve wearing comfort and avoid discomfort caused by direct contact between support components and skin. Meanwhile, the three-layer composite fabric covering sheet 24 extending to the front of the torso covering portion 12 enables the entire front of the brassiere to maintain good shaping effects while better conforming to human torso curves, thereby improving the overall wearing experience.

As shown in FIG. 4, in one implementation, the W-shaped support strip 23 comprises a first W-shaped strip 231, a first plastic bone 232, a second plastic bone 233, and a second W-shaped strip 234, where the first plastic bone 232 and the second plastic bone 233 are disposed in the same layer, while the first W-shaped strip 231, the first plastic bone 232, and the second W-shaped strip 234 are sequentially laminated from the inner to outer layers. In one embodiment, the first plastic bone 232 and the second plastic bone 233 are made of soft plastic material. In one embodiment, the first plastic bone 232 and the second plastic bone 233 are made of thermoplastic TPU (Thermoplastic Polyurethane).

The first W-shaped strip 231 and second W-shaped strip 234 provide fundamental structural support for the W-shaped support strip 23, ensuring its deformation resistance during use. The first plastic bone 232 and second plastic bone 233 are respectively positioned on both sides between the first W-shaped strip 231 and second W-shaped strip 234, with their arrangement further enhancing the overall supporting strength and stability of the W-shaped support strip 23. This configuration enables the W-shaped support strip 23 to better distribute pressure when supporting the brassiere, thereby improving both the shaping effect and wearing comfort. This multi-layer laminated structural design effectively combines the characteristics of different materials—it maintains the support performance while preserving appropriate softness, thereby avoiding wearer discomfort caused by excessive rigidity.

As shown in FIG. 1, in one implementation, the first U-shaped strip 21 and the second U-shaped strip 22 at least partially overlap 202 at the position between the two breasts when worn.

This overlapping design enhances the gathering effect of the brassiere in the central breast area, where the coordinated interaction between the two U-shaped strips guides breast tissue from both sides toward the center to create fuller and more uplifted breast contours. Simultaneously, the overlapping portion forms a stable support point that works in conjunction with the W-shaped support strip 23 to further improve the overall support performance of the brassiere, effectively preventing breast sagging while reducing breast movement during exercise or daily activities to provide more reliable protection for the wearer. Moreover, this partially overlapping structure is not completely rigid but retains a certain degree of flexibility, allowing the brassiere to maintain optimal fit when adapting to different body types and activity states, thereby preventing localized areas from being too tight or too loose and ensuring more comfortable and natural wear.

As shown in FIG. 4, in one implementation, the first W-shaped strip 231 and the second W-shaped strip 234 are adhesively bonded, thereby sandwiching the first plastic bone 232 and the second plastic bone 233 between the first W-shaped strip 231 and the second W-shaped strip 234. The first W-shaped strip 231 and the second W-shaped strip 234 are bonded together through elastic adhesive strips 200 and 300.

This bonding method ensures secure connection between the first W-shaped strip and the second W-shaped strip while the incorporation of elastic adhesive strips provides the entire W-shaped support structure with controlled elastic flexibility. During wearer movement, the elastic adhesive strips correspondingly stretch and contract with natural breast motion, preventing uncomfortable pressure caused by excessive rigidity of the support strips. With the first and second plastic bones sandwiched in between, the configuration achieves dual benefits: the W-shaped strips' enveloping effect maintains the plastic bones' shape stability to prevent displacement or deformation during wear, while simultaneously enabling even distribution of supporting forces across the underside and sides of breasts through the W-shaped strips, thereby further optimizing the brassiere's support performance. This allows wearers to enjoy both excellent shaping effects and lasting comfort with reliable support.

As shown in FIG. 4, in one implementation, the first plastic bone 232 and the second plastic bone 233 are arc-shaped and positioned along the lower edge of the wearer's breasts when worn, with the first plastic bone 232 and the second plastic bone 233 corresponding to the left and right breasts of the human body respectively.

This arcuate design closely conforms to the natural curvature of the breast's lower edge. When the wearer is standing or sitting, the curved structure of the plastic bones provides upward supporting force along the breast contour, effectively bearing the weight of the breasts and reducing pressure on the shoulders and back. The bilateral arrangement enables independent yet balanced support for both breasts, preventing sagging or deformation caused by uneven force distribution. During daily activities, the arced plastic bones also provide stabilizing function, significantly reducing breast movement during physical activity to enhance wearing stability and security.

In one embodiment, the first W-shaped strip 231 and the second W-shaped strip 234 are softer than the first plastic bone 232 and the second plastic bone 233, thereby providing cushioning to prevent discomfort that may be caused by the relatively harder first plastic bone 232 and second plastic bone 233 to the wearer.

This soft characteristic enables the W-shaped strips 231, 234 to better adapt to body movements when the brassiere is worn. When the wearer performs actions such as bending or turning, the W-shaped strips 231, 234 can flexibly deform according to body contours, reducing skin friction and pressure sensation. Meanwhile, the cushioning effect of the W-shaped strips 231, 234 also prevents direct friction between the edges of the plastic bones 232, 233 and fabric materials, thereby extending the brassiere's service life. Furthermore, the softer W-shaped strips 231, 234 do not compromise the support performance of the plastic bones 232, 233 themselves. On the contrary, while maintaining the support function of the plastic bones 232, 233, the W-shaped strips 231, 234 can further enhance the overall wearing comfort of the brassiere through the W-shaped strips' own elasticity, achieving a better balance between support and comfort.

In one implementation, the first W-shaped strip 231 is formed by laminating three fabric layers, comprising sequentially stacked polyester filament layer, low-elastic yarn layer, and polyester filament layer.

This three-layer composite structure combines the characteristics of different materials to provide the first W-shaped strip 231 with both softness and appropriate stiffness. The outer polyester filament layers offer excellent abrasion resistance and wrinkle recovery, enhancing the overall durability of the first W-shaped strip 231 and minimizing deformation during prolonged use. The middle low-elastic yarn layer provides moderate elastic recovery, enabling the strip to quickly return to its original shape after stretching and ensuring continuous skin contact and cushioning during body movements. By using polyester filament layers for both inner and outer layers, the symmetrical structural design prevents uneven stress distribution caused by material differences, further improving the structural stability of the first W-shaped strip 231. This allows it to effectively provide cushioning when working with the plastic bones 232, 233 while maintaining the integrity of the brassiere's overall support system without becoming structurally compromised.

In one implementation, the second W-shaped strip 234 is formed by a three-layer fabric composite, comprising sequentially laminated polyester filament layer, low-elastic yarn layer, and polyester filament layer.

Building upon the structural advantages of the first W-shaped strip 231, this three-layer composite structure has been further optimized according to the functional positioning of the second W-shaped strip 234 within the brassiere's overall support system. The outer polyester filament layers maintain their abrasion resistance and wrinkle recovery properties, effectively withstanding friction against clothing during wear and damage from routine washing, thereby ensuring the second W-shaped strip's 234 shape stability during prolonged use. While providing elastic recovery, the low-elastic yarn core layer has been adjusted in its elasticity coefficient to emphasize static cushioning performance compared to the first W-shaped strip 231. When the brassiere is in its natural fitted state, the slight elasticity of the low-elastic yarn layer helps distribute pressure beneath the breasts to avoid localized compression. The symmetrical polyester filament layer design ensures more uniform force transmission when the second W-shaped strip 234 connects with other brassiere components. Particularly when interacting with the side wings and underband areas, its stable structural characteristics enhance the brassiere's overall lifting capacity, preventing support point displacement caused by deformation of the second W-shaped strip 234, thereby improving wearing comfort and stability.

In one implementation, the first W-shaped strip 231 and the second W-shaped strip 234 have a higher elastic modulus than the brassiere body 10.

This design enables the first W-shaped strip 231 and second W-shaped strip 234 to serve as core supporting components within the brassiere's overall structure, effectively resisting gravitational forces from the breasts and various external forces during wear, thereby preventing insufficient support caused by excessive elasticity of the brassiere body fabric. During the wearer's daily activities or light exercise, the first W-shaped strip 231 and second W-shaped strip 234 maintain their shape stability due to their higher elastic modulus, without excessive stretching or distortion that might follow deformation of the brassiere body. This ensures continuous and reliable breast support, maintaining optimal shaping performance of the brassiere under different conditions, while further enhancing both practicality and durability of the garment.

In one implementation, both the inner layer 15 and the outer layer 17 are made of nylon-spandex or polyester-spandex fabric.

Nylon-spandex and polyester-spandex fabrics are both elastic textiles that combine spandex fibers with either nylon or polyester fibers through interwoven construction. This blend preserves the abrasion resistance and wrinkle recovery of nylon or the crispness and easy-care advantages of polyester, while incorporating spandex's high elasticity to endow the fabric with excellent stretch recovery properties.

When used for both inner and outer layers, these fabrics can closely conform to breast contours while flexibly stretching with the wearer's movements, significantly reducing fabric-skin friction and constriction. Moreover, nylon-spandex and polyester-spandex fabrics demonstrate superior breathability and moisture absorption, accelerating sweat evaporation from the skin surface to maintain dryness and comfort in the breast area, preventing discomfort caused by heat buildup.

Additionally, these fabrics exhibit strong structural stability, resisting slackening or deformation during extended wear. They work synergistically with support components like the first W-shaped strip and second W-shaped strip to ensure the brassiere provides stable support while maintaining aesthetically pleasing contours and long-term durability.

As shown in FIGS. 1 and 2, in one implementation, the brassiere further comprises shoulder straps 50 connected to the brassiere body 10. The shoulder straps 50 may be provided in a pair, corresponding to the wearer's left and right shoulders respectively.

The shoulder straps 50 may feature an adjustable design with multiple adjustment buckles along their surface, enabling wearers to freely modify strap length according to their shoulder shape and comfort requirements to ensure the brassiere body 10 maintains stable contact with the breasts while preventing strap slippage or excessive tightness. The shoulder straps 50 may utilize elastic fabrics consistent with the inner layer 15 and outer layer 17, such as nylon-spandex or polyester-spandex blends, ensuring the straps possess both excellent elasticity and load-bearing capacity when lifting the brassiere body while reducing pressure on shoulder skin. Furthermore, the connection points between shoulder straps 50 and brassiere body 10 may employ reinforcement techniques like double-stitched seams or added reinforcement panels to enhance structural strength at the joints, preventing strap detachment after prolonged use and further improving the brassiere's overall stability and service life.

The embodiments of the present application configure the brassiere to comprise a brassiere body 10 that is further subdivided into two distinct portions: a breast-covering portion 11 and a torso-covering portion 12. The breast-covering portion 11 is specifically designed to comprehensively cover the wearer's breast area during wear, thereby achieving fundamental breast encapsulation functionality; while the torso-covering portion 12 is configured to cover the torso region surrounding the breasts in the worn state, providing additional conformability and comfort. Furthermore, the brassiere body 10 features two critical edge contours: a first edge 13 positioned adjacent to the wearer's underarm during wear, and a second edge 14 situated near the wearer's neckline area, with both edges meticulously designed to enhance anatomical conformity.

To augment functional performance, these embodiments incorporate a support structure 20 that is securely connected to the brassiere body 10 and exhibits substantially greater rigidity than the brassiere body 10 itself. This high-rigidity support structure 20 is engineered to extend peripherally around the wearer's breasts during wear, thereby delivering robust supporting force. Notably, the extension range of the support structure 20 is precisely designed to terminate at the first edge 13 of the brassiere body 10 in the worn state-a configuration that ensures both comprehensive coverage of critical support zones and harmonious integration with the overall structure.

Additionally, the application features a cushion panel 30 design that is joined to the brassiere body 10 at the first edge 13. The cushion panel 30 incorporates a distinctive widened underarm edge profile that effectively prevents direct contact between the terminal end 201 of the support structure 20 and the wearer's skin, thereby mitigating discomfort caused by structural rigidity. Simultaneously, the extension of the support structure 20 to the first edge 13 enables complete support performance across an expanded area, significantly enhancing wearability. Beyond these functions, the cushion panel 30 itself provides shaping benefits, particularly in the underarm region where it effectively gathers lateral breast tissue to create more aesthetically natural contours. In summary, through these multidimensional optimizations, the application successfully balances functional performance, comfort, and aesthetics to meet demands for premium-quality brassieres.

To make the objectives, technical solutions, and advantages of the present application clearer, the following further describes the present application in detail with reference to the accompanying drawings and embodiments. It should be understood that the specific embodiments described herein are merely intended to explain the present application and are not intended to limit the present application.

The above descriptions are only specific implementations of the present application. It should be noted that, for those of ordinary skill in the art, various modifications and refinements can be made without departing from the principles of the present application. These modifications and refinements should also be regarded as falling within the protection scope of the present application.

What is claimed is:

1. A brassiere comprising:

a brassiere body comprising a breast-covering portion configured to cover a wearer's breasts when worn and a torso-covering portion configured to cover a wearer's torso surrounding the breasts when worn, the brassiere body having a first edge adjacent a wearer's underarm when worn and a second edge adjacent a wearer's neckline when worn;

a support structure connected to the brassiere body, wherein the support structure is configured to extend around the wearer's breasts when worn to provide breast support, the support structure extending to and terminating at the first edge; wherein the support structure comprises a first U-shaped strip and a second U-shaped strip disposed in a same layer; a W-shaped support strip; and a covering sheet; wherein the first U-shaped strip, the W-shaped support strip, and the covering sheet are sequentially stacked from inside to outside; and a cushion panel joined to the brassiere body at the first edge.

2. The brassiere of claim 1, wherein the cushion panel has a higher elastic modulus than the breast-covering portion.

3. The brassiere of claim 1, wherein the cushion panel and the brassiere body partially overlap at a joining position therebetween, and the cushion panel is closer to a wearer's skin than the brassiere body at the joining position.

4. The brassiere of claim 1, wherein the cushion panel has a maximum width at a first location corresponding to a first end of the support structure.

5. The brassiere of claim 4, wherein the cushion panel tapers gradually from the first location toward both ends along a length direction of the cushion panel.

6. The brassiere of claim 1, wherein an extension area of the cushion panel covers at least 80% of the first edge.

7. The brassiere of claim 6, wherein the extension area of the cushion panel covers the entire first edge.

8. The brassiere of claim 1, wherein the support structure is configured to extend between the wearer's breasts when worn and terminates at the second edge.

9. The brassiere of claim 1, wherein the support structure is disposed on an outer surface of the brassiere body and protrudes outward relative to the outer surface.

10. The brassiere of claim 1, further comprising a support structure covering layer that at least covers the support structure and is bonded thereto, the covering layer being disposed on an outer side of the support structure.

11. The brassiere of claim 10 wherein the covering layer is folded around at least part of an edge of the support structure to cover an inner side of the support structure.

12. The brassiere of claim 10, wherein the covering layer is adhesively bonded to the support structure.

13. The brassiere of claim 1, wherein the support structure is adhesively bonded to the brassiere body.

14. The brassiere of claim 1, wherein the W-shaped support strip comprises:

a first W-shaped strip;

first and second plastic bones disposed in a same layer; and a second W-shaped strip;

wherein the first W-shaped strip, the first plastic bone, and the second W-shaped strip are sequentially stacked from inside to outside.

15. A brassiere comprising:

a brassiere body comprising a breast-covering portion configured to cover a wearer's breasts when worn and a torso-covering portion configured to cover a wearer's torso surrounding the breasts when worn, the brassiere body having a first edge adjacent a wearer's underarm when worn and a second edge adjacent a wearer's neckline when worn; and a support structure connected to the brassiere body, wherein the support structure is configured to extend around the wearer's breasts when worn to provide breast support wherein the support structure comprises a first U-shaped strip and a second U-shaped strip disposed in a same layer; a W-shaped support strip; and a covering sheet; wherein the first U-shaped strip, the W-shaped support strip, and the covering sheet are sequentially stacked from inside to outside.

16. The brassiere of claim 15, further comprising a cushion panel joined to the brassiere body at the first edge, wherein the cushion panel has a higher elastic modulus than the breast-covering portion, the support structure is disposed on an outer surface of the brassiere body and protrudes outward relative to the outer surface.

17. The brassiere of claim 15, wherein the support structure extending to and terminating at the first edge, and the support structure is configured to extend between the wearer's breasts when worn and terminates at the second edge, the support structure is disposed on an outer surface of the brassiere body and protrudes outward relative to the outer surface.

18. The brassiere of claim 15, further comprising a support structure covering layer that at least covers the support structure and is bonded thereto, the covering layer being disposed on an outer side of the support structure, the support structure is disposed on an outer surface of the brassiere body and protrudes outward relative to the outer surface.

* * * * *